US005119137A

United States Patent [19]

Katagata

[11] Patent Number: 5,119,137

[45] Date of Patent: Jun. 2, 1992

[54] STRUCTURE AND METHOD OF MOUNTING RECORDING UNITS IN ELECTROPHOTOGRAPHIC RECORDING APPARATUS

[75] Inventor: Satoshi Katagata, Tokyo, Japan

[73] Assignee: Kabushiki Kaisha Toshiba, Kawasaki, Japan

[21] Appl. No.: 714,976

[22] Filed: Jun. 13, 1991

Related U.S. Application Data

[63] Continuation of Ser. No. 496,994, Mar. 22, 1990, abandoned.

[30] Foreign Application Priority Data

Mar. 24, 1989 [JP] Japan ..... 1-73484

[51] Int. Cl.[5] ..... G03G 15/06

[52] U.S. Cl. ..... 355/245; 118/661; 355/210

[58] Field of Search ..... 355/245, 246, 210, 211, 355/212, 251, 213, 259, 252, 261; 118/645, 661, 651

[56] References Cited

U.S. PATENT DOCUMENTS

| | | | |
|---|---|---|---|
| 3,953,121 | 4/1976 | Reichart, Jr. | 355/251 X |
| 4,258,372 | 3/1981 | Ishikawa | 355/245 X |
| 4,271,786 | 6/1981 | Buckley et al. | 355/245 X |
| 4,563,074 | 1/1986 | Tsutsui et al. | 355/245 |
| 4,952,989 | 8/1990 | Kawano et al. | 355/210 |

FOREIGN PATENT DOCUMENTS

| | | | |
|---|---|---|---|
| 0219975 | 9/1986 | Japan | 355/245 |
| 0112174 | 5/1987 | Japan | 355/245 |

*Primary Examiner*—A. T. Grimley
*Assistant Examiner*—Thu Dang
*Attorney, Agent, or Firm*—Finnegan, Henderson, Farabow, Garrett and Dunner

[57] ABSTRACT

A structure and method for mounting recording units in an electrophotgraphic recording apparatus wherein collar members provided at both ends of a photosensitive drum or a sleeve are disposed to come into tight contact with the opposing sleeve or photosensitive drum to secure a uniform developing gap therebetween and wherein a developing unit opposed to a drum unit is pivotably supported at a longitudinal central point of the developing unit. Even when the photosensitive drum is biased in its central axis, the above pivotable movement of the developing unit enables the sleeve to flexibly follow the axis biasing movement and also enables the rotational axes of the photosensitive drum and sleeve to be kept in their parallel relation, whereby the uniform developing gap can be positively secured at all times along the longitudinal direction of the photosensitive drum, and this can contribute to the stable picture image recording operation.

21 Claims, 8 Drawing Sheets

STRUCTURE AND METHOD OF MOUNTING RECORDING UNITS IN ELECTROPHOTOGRAPHIC RECORDING APPARATUS

This application is a continuation, of application Ser. No. 07/496,994, filed Mar. 22, 1990 now abandoned.

BACKGROUND OF THE INVENTION

1. Field of the Invention

The present invention relates to improvements in a structure and method for mounting a drum unit and a developing unit in an electrophotographic recording apparatus so as to secure a uniform developing gap between a photosensitive drum and a sleeve.

2. Description of the Related Art

As well known, in an electrophotographic recording apparatus, such developing agent as toner is applied from a developing unit to electrostatic latent images formed on a photosensitive drum in a series of electrophotographic recording processes to thereby realize picture images.

A developing gap between the photosensitive drum and a sleeve provided in the developing unit in the developing process exercises a great effect on the quality of a picture image to be recorded through the subsequent transfer and fixing processes.

Thus, for the purpose of securing a good quality of recording picture image, it is necessary to keep the developing gap uniform at all times.

Meanwhile, there are at present a fairly large number of electrophotographic recording apparatuses wherein a drum unit is provided separately from a developing unit. Even for this type of apparatuses, however, these recording units must be mounted in the apparatus so as to secure such a uniform developing gap as mentioned above between a photosensitive drum and a sleeve, as a matter of course.

Brief explanation will next be directed to an ordinary method of keeping the developing gap uniform in this electrophotographic recording apparatus by referring to FIGS. 8 and 9.

In FIG. 8, a photosensitive drum 1 having a rotational axis 1*a*, which is provided in a drum unit, rotates in such a direction as shown by an arrow A.

A sleeve 2, which is provided in a developing unit, has the same cylindrical shape as the photosensitive drum 1.

The sleeve 2 having a rotational axis 2*a* parallel to the axis 1*a* of the drum 1, rotates in such a direction as shown by an arrow B following the rotation of the drum 1.

Provided at left and right ends of the sleeve 2 are roller-shaped collars 3 which have respectively a diameter larger than that of the sleeve 2 and have the common central axis 2*a*.

With such a structure, a predetermined difference in outer diameter between the sleeve 2 and the collars 3 corresponds to a developing gap g to be explained later.

In this case, the collars 3 loosely fittedly receive the sleeve 2 about the central axis 2*a* and respectively rotate independently of the sleeve 2.

When mounted in the recording apparatus, the photosensitive drum 1 and the sleeve 2 are made close to each other until the collars 3 provided at the left and right ends of the sleeve 2 are brought into tight contact with the peripheral surface of the drum 1 and the axes 1*a* and 2*a* of the drum 1 and sleeve 2 are kept parallel to each other.

Shown in FIG. 9 is the above positional relationship between the drum 1 and sleeve 2 when viewed from such a direction as shown by an arrow C in FIG. 8.

Under such a condition, the photosensitive drum 1 and the sleeve 2 define therebetween the developing gap g which corresponds to the aforementioned diameter difference between the sleeve 2 and collars 3 as shown in the drawing.

In this type of prior art electrophotographic recording apparatus, the above method has been employed for the purpose of obtaining the uniform developing gap g and the actual mounting of the drum unit and developing unit into the apparatus has been realized with such a structure as shown in FIG. 10.

More specifically, in FIG. 10, a rotary shaft 4*a* parallel to the central axis 2*a* of the sleeve 2 is provided at a position different from the central axis 2*a* in a developing unit 4 so that the developing unit 4 can be suspended from the rotary shaft 4*a*.

In this case, when the developing unit 4 is rotated by its weight on the rotary shaft 4*a*, this causes the collars 3 to be tightly contacted with the photosensitive drum 1, so that the uniform developing gap g can be obtained between the drum 1 and sleeve 2 by the above method.

In the case of such a mounting structure of these recording units, however, since the central axes 1*a* and 2*a* of the photosensitive drum 1 and sleeve 2 are provided respectively as fixed, these members 1 and 2 are frequently biased in their axes when subjected to an external force or the like.

In case the rotary axis 4*a* of the developing unit 4 is once biased with respect to the central axis 1*a* for example, these axes will never regain their parallel relation thereafter.

In such a situation, one or both of the two collars 3 provided at the both ends of the sleeve 2 are disposed as floated from the photosensitive drum 1. This disadvantageously results in that it becomes impossible to secure the uniform developing gap between the photosensitive drum 1 and sleeve 2 along their longitudinal direction, which leads to remarkable deterioration of the quality of recording picture image.

SUMMARY OF THE INVENTION

It is an object of the present invention to provide a structure for mounting recording units in an electrophotographic recording apparatus, which, even when an external force or the like applied to a drum unit or a developing unit causes both axes of the photosensitive drum and sleeve to be mutually biased, can always secure a uniform developing gap between the both.

Another object of the present invention is to provide a structure for mounting a drum unit and a developing unit, which can accurately position the sleeve at a predetermined scanning position on a photosensitive drum.

A further object of the present invention is to provide a structure for mounting a drum unit and a developing unit, in which a mechanism for keeping a developing gap uniform can be realized in various ways to satisfy many design requirements.

Yet a further object of the present invention is to provide an improved structure for mounting a drum unit and a developing unit, in which the developing unit is provided as opposed to the drum unit so as to secure a uniform developing gap between a photosensitive drum and a sleeve.

Yet another object of the present invention is to provide a method of mounting a photosensitive drum and a developing unit in an electrophotographic recording apparatus, wherein, even in an event where an external force or the like applied to a drum unit or the developing unit causes the central axes of these units to be mutually biased, a uniform developing gap can be always secured between the photosensitive drum and a sleeve.

In accordance with the present invention, the above objects can be attained by providing a structure for mounting recording units which comprises collar members provided at both ends of the photosensitive drum or the sleeve in its rotational axis direction to be tightly contacted with the photosensitive drum or the sleeve opposed thereto to provide a uniform spacing distance corresponding to the developing gap along the rotational axis direction between the photosensitive drum and sleeve; a projection member provided at a longitudinal central point of the drum unit or developing unit; and pushing means for pushing the developing unit toward the drum unit to cause the projection member to abut against the opposing unit or a body casing and to cause the collar members to come into tight contact with the opposing photosensitive drum or sleeve.

In accordance with an aspect of the present invention, there is provided guiding members for slidably guiding the developing unit to cause the developing unit to be kept as opposed to the drum unit and to cause the sleeve to be positioned under influence of a pushing pressure from the pushing means at a predetermined scanning position on the photosensitive drum; if necessary, the unit opposed to the unit having the projection member provided thereto is provided with a recessed portion which is provided as opposed to the projection member and which has a shape suitable for fitted reception of the projection member.

In accordance with another aspect of the present invention, not only the collar members are provided to the rotational axis of the photosensitive drum and the projection member is provided to the drum unit, but there may be also employed such structures that the collar members are provided to the rotational axis of the photosensitive drum and the projection member is provided to the developing unit, the collar members are provided to the rotational axis of the sleeve and the projection member is provided to the drum unit, and that the collar members ar provided to the rotational axis of the sleeve and the projection member is provided to the developing unit.

In the present invention, in pace of the projection member employed in the above mounting structure, a hook mechanism for engagedly supporting the developing unit at its longitudinal central point thereon may be provided.

In accordance with a further aspect of the present invention, two collar members provided to both ends of the photosensitive drum or sleeve in its rotational axis direction are brought into tight contact with the photosensitive drum or sleeve opposed thereto to keep a uniform spacing distance corresponding to the developing gap along the rotational axis direction between the photosensitive drum and sleeve; and the developing unit opposed to the drum unit is pivotably supported at its longitudinal central point thereof to allow the sleeve to movably follow a biasing action of the rotational axis of the photosensitive drum while following a biasing movement of the rotational axis of the photosensitive drum with a parallel relation kept between the rotational axes of the sleeve and photosensitive drum and with the spacing distance between the sleeve and photosensitive drum maintained.

In this way, in the mounting structure of the present invention, for the purpose of providing the uniform developing gap, the collar members are provided at the both ends of the photosensitive drum or sleeve, the projection member is provided at the single longitudinal central point of the drum unit or developing unit, and the developing unit is engaged with the drum unit at the three points of the projection member and collar members. As a result, even when the central axis of the photosensitive drum is biased, the developing unit is pivoted on the projection member as a supporting point to follow the biasing movement, with the tight contact of the developing unit with the collar members being maintained.

So long as the tight contacted relation with the collar members is maintained, the central axis of the photosensitive drum is kept to be parallel to that of the sleeve and thus the uniform developing gap can be always secured between the both along their central-axis direction.

In the present invention, further, the developing unit is held as opposed to the drum unit and the guiding members are provided to allow slidable movement of the developing unit until the sleeve is positioned at the predetermined scanning position on the photosensitive drum. Accordingly, only by pushing the developing unit toward the drum unit on the guiding members therealong, the sleeve in the unit can be easily positioned at the predetermined scanning position on the photosensitive drum.

In this case, when the developing unit is pushed while the projection member is fitted into the recessed portion provided in the opposing unit, the above positioning can be further facilitated.

In addition, since the collar members, projection member, the drum unit and developing unit are provided in suitable combinations therebetween in the present invention, various modifications to secure the uniform developing gap may be realized to meet the design requirements of the actual applications.

In the present invention, the projection member is replaced by the hook mechanism for supporting the developing unit at one point located on the longitudinal central portion of the developing unit. However, this structure is essentially the same as the case of using the projection member in that the developing unit can be pivoted on the hook mechanism as the supporting point. Thus, there can be also secured the unifrom developing gap between the photosensitive drum and sleeve.

Moreover, in the invention, for the purpose of obtaining the uniform developing gap, the developing unit is supported with respect to the drum unit to be pivoted at one supporting point in the longitudinal central portion of the developing unit, while the collar members are brought into tight contact with the photosensitive drum. As a result, even when the central axis of the photosensitive drum is biased, the opposing developing unit is pivoted so that the central axis of the photosensitive drum can be made parallel to the central axis of the sleeve in the developing unit, whereby the uniform developing gap can be always secured between the photosensitive drum and sleeve and thus the uniform gap can contribute to a remarkable improvement in the quality of recording picture image.

DESCRIPTION OF THE PREFERRED EMBODIMENT

Embodiments of the present invention will be detailed by referring to the accompanying drawings.

Referring first to FIGS. 1(*a*)-1(*c*), there is shown a structure of a major part of an electrophotographic recording apparatus. More specifically, FIG. 1(*b*) is a plan view as seen from the top of the structure and FIG. 1(*c*) is a side view as seen from such a direction as shown by an arrow D in FIG. 1(*b*), and FIG. 1(*a*) is a detailed view of a portion of FIG. 1(*b*).

In FIGS. 1(*a*)-(*c*), a photosensitive drum 1 is disposed in a drum unit 5 as rotatably supported at its rotational axis 1*a* in a casing 7.

Figure 8:
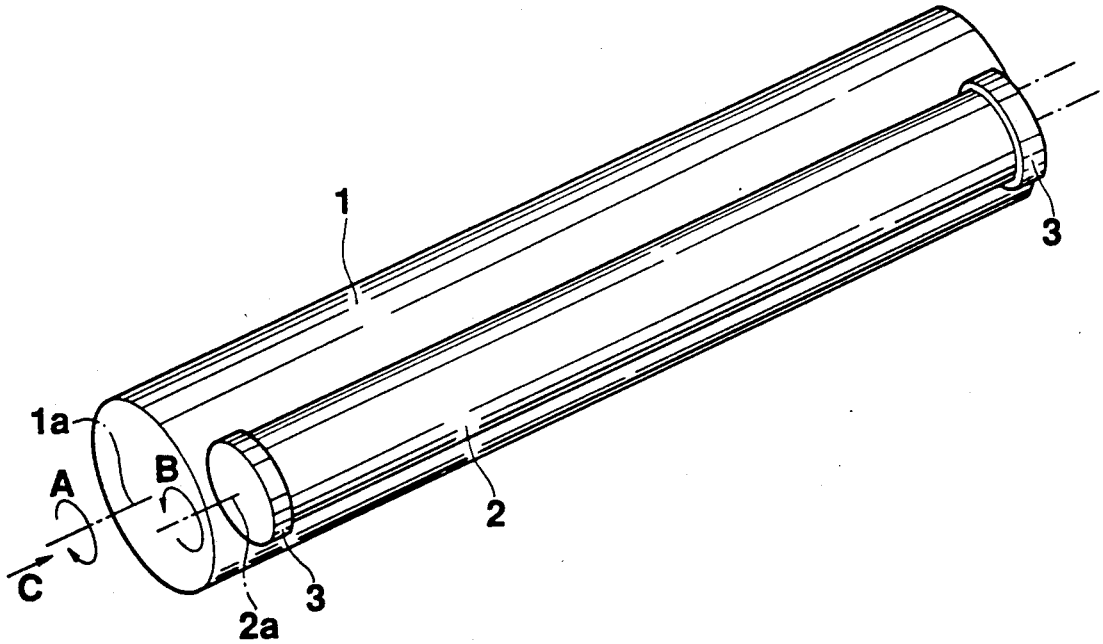
FIG. 8 is a perspective view for explaining an ordinary method of obtaining a uniform developing gap in this sort of electrophotographic recording apparatus.
Figure 9:
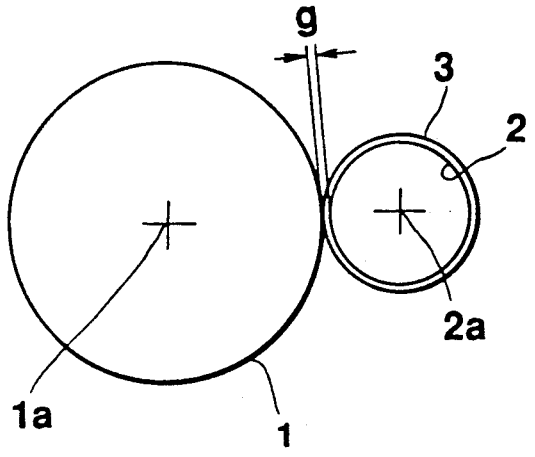
FIG. 9 is a side view of FIG. 8 as seen from a direction shown by an arrow C.
Figure 10:
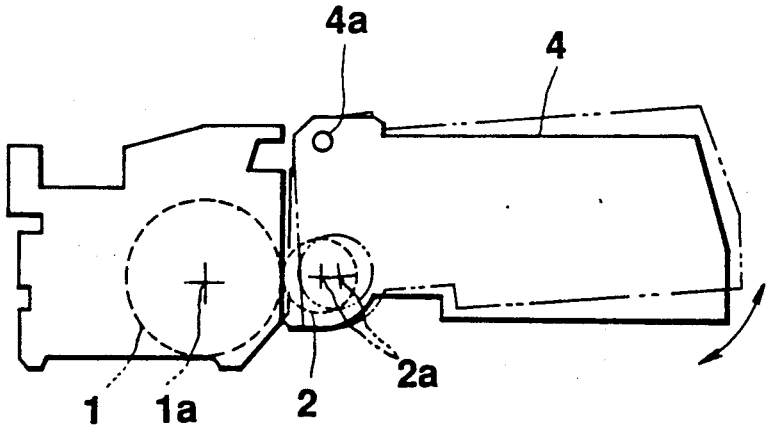
FIG. 10 PRIOR ART
FIG. 10 shows a prior art structure for mounting recording units in a prior art electrophotographic recording apparatus.

A sleeve 2, which is disposed in a developing unit 4, is provided at its both ends with collars 3 which are the same as those in FIG. 8. More in detail, the collars 3 are provided to rotate about an axis 2*a* of the sleeve 2 in such a tight contacted relation with the photosensitive drum 1.

The developing unit 4 is provided with guide pieces 40 on its both sides in the longitudinal direction (in the vertical direction in FIG. 1(*b*)). Each of the guide pieces 40 is formed at its predetermined lower position with a sliding member 41.

The developing unit 4 having such a structure as mentioned above is carried on guiding members 6 (shown by a dot-dash line in FIG. 1(*c*)) fixedly mounted to the body of the recording apparatus.

More specifically, the guiding members 6 function to bear thereon the developing unit 4 at the guiding pieces 40 and to slidably guide the unit 4 toward directions shown by arrows E through the sliding members 41 attached to the guiding pieces 40.

Due to such a mechanism, the developing unit 4 placed on the body-side guiding members 6 is subjected to a restriction of its downward (in the gravity direction) movement, in which case the positions of the developing unit 4 on the body-side guiding members 6 are set so that the sleeve 2 stops at a predetermined scanning position on the peripheral surface of the photosensitive drum 1.

An interval between the body-side guiding members 6 in the longitudinal direction of the installed developing unit 4 is set so that the movement of the developing unit 4 in the longitudinal direction is restricted when the sleeve 2 is disposed to face the drum 1 at the predetermined scanning position.

With such an arrangement, the developing unit 4 can be slidably moved on the body-side guiding members 6 therealong in the arrow-E directions through the sliding members 41 contacted with the guiding members 6 as mentioned above. That is, the developing unit 4 can be slidably moved freely toward and away from the drum unit 5 in such a condition that the unit 4 is positively supported through the engagement between the bodyside guiding members 6 and the guiding pieces 40.

In this case, since the mounting positions of the body-side guiding members 6 and the spacing therebetween are set as mentioned above, the user of the electrophotographic recording apparatus can easily position the sleeve 2 of the developing unit 4 at the predetermined scanning position on the peripheral surface of the photosensitive drum 1 only by pushing the unit 4 forward to the foremost end of the drum unit 5.

Further, the developing unit 4 of the present invention is provided at its longitudinal central position with a projection member 42 which is extruded toward the drum unit and also provided on its rear side with a spring 8.

The spring 8 acts to provide a resilient force to push the developing unit 4 toward the drum unit 5.

The pushing force of the spring 8 enables a contact of the collars 3 with the photosensitive drum 1 between the developing unit 4 and drum unit 5 and at the same time, also enables the abutment of the projection member 42 against the casing 7 which forms the body of the recording apparatus.

Under such a condition, the developing unit 4 is engaged with the drum unit 5 at the three points of the projection member 42 and the two collars 3 in the arrow E direction.

In this case, the tightly contacted engagement of the collars 3 with the photosensitive drum 1 causes generation of a uniform developing gap g corresponding to a difference in diameter between the sleeve 2 and collars 3 between or the drum 1 and sleeve 2.

Meanwhile, the above condition is realized only by pushing the developing unit 4 slidably carried on the body-side guiding members 6 toward the drum unit 5 through the spring 8. For this reason, the developing unit 4 can be freely pivoted on the projection member 42 provided at the longitudinal central position of the unit 4 as a supporting point in F and F' directions (refer to FIG. 1(*b*)).

Therefore, even if the above condition is shifted and the axis 1*a* of the photosensitive drum 1 is biased, the sleeve 2 is flexibly moved to follow the biasing movement while the collars 3 come into tight contact with the photosensitive drum 1, whereby the uniform developing gap g can be secured at all times between the drum 1 and sleeve 2 along the longitudinal direction.

Although the collars 3 have been provided on the side of the sleeve 2 in order to obtain the developing gap g in the foregoing embodiment, the collars 3 may be provided on the side of the photosensitive drum 1 facing the sleeve 2.

Figure 2:
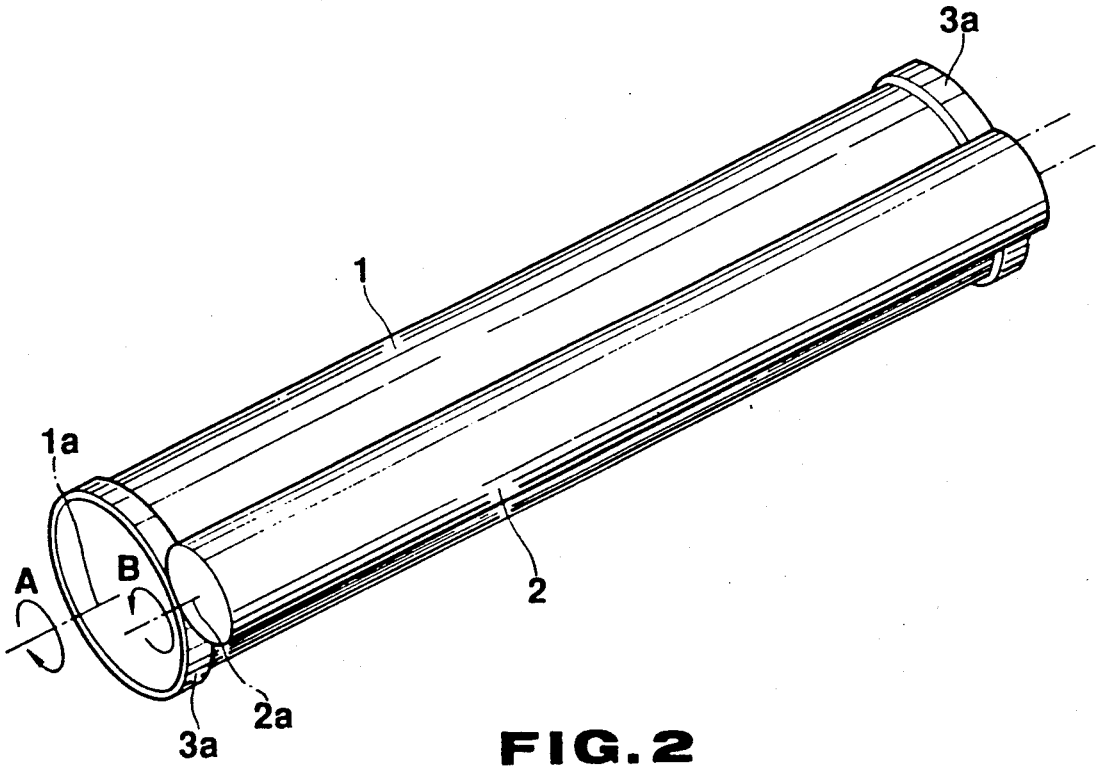
FIG. 2 is a perspective view showing another embodiment of collar members used in the electrophotographic recording apparatus of the present invention.

An exemplary structure of the latter case is shown in FIG. 2, in which collars 3a, which are provided at both ends of the photosensitive drum 1, comprise each a roller-shaped member having a central rotational axis 1a and a diameter larger than that of the drum 1.

It goes without saying that a difference in diameter between the photosensitive drum 1 and collars 3a corresponds to the aforementioned developing gap g.

Even with this structure, the drum 1 is loosely fitted in the collars 3a with respect to the central axis 1a so that these members 1 and 3a are rotated about the axis 1a independently of each other.

In this way, when attention is directed to an idea that, in order to obtain the developing gap g, the collars 3 are provided not only to the sleeve side 2 but also to the drum 1 side, it will be easily appreciated that the mounting position of the projection member 42 forming one of the three points other than the two points of the collars 3 may not be also limited to the developing unit 4 side alone mentioned above.

Explanation will be made as to various examples of the structure of the present invention which may be embodied based on the above idea, by referring to FIGS. 3(a) to 6(b).

Figure 3A:
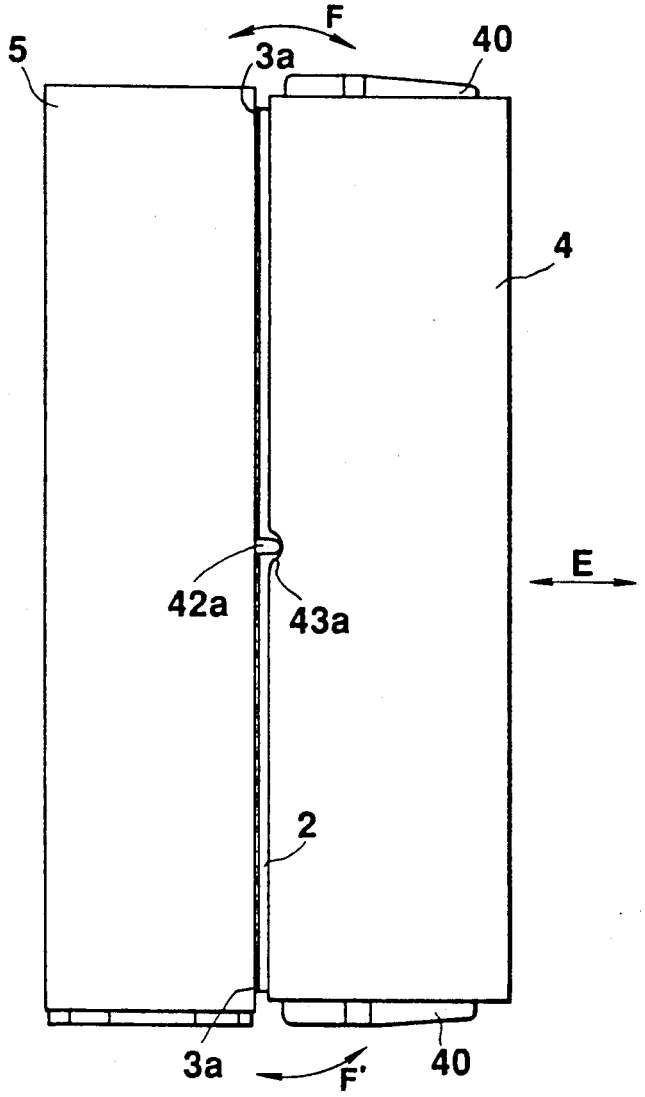
FIGS. 3(*a*) to 6(*b*), show, respectively in plan and side views, other different embodiments of the electrophotographic recording apparatus of the present invention.
Figure 3B:
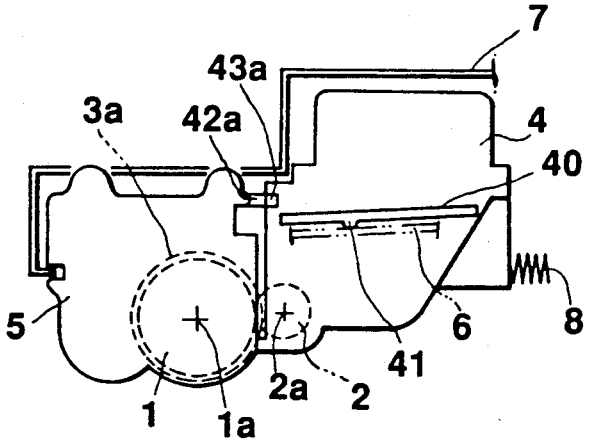

In an example of FIGS. 3(a) and 3(b) first of all, the collars 3a are provided on the side of the photosensitive drum 1, while a projection member 42a is provided on the side of the drum unit 5.

Figure 1A:
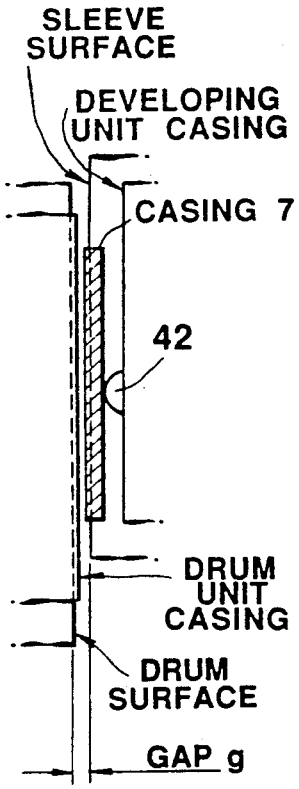
FIGS. 1(*a*)-1(*c*) show a structure of a major part of an electrophotographic recording apparatus in accordance with an embodiment of the present invention, wherein FIG. 1(*b*) is a plan view of the same, FIG. 1(*c*) is a side view of FIG. 1(*b*) as seen from a direction shown by an arrow D, and FIG. 1(*a*) is a detailed view of a portion of FIG. 1(*b*)
Figure 1B:
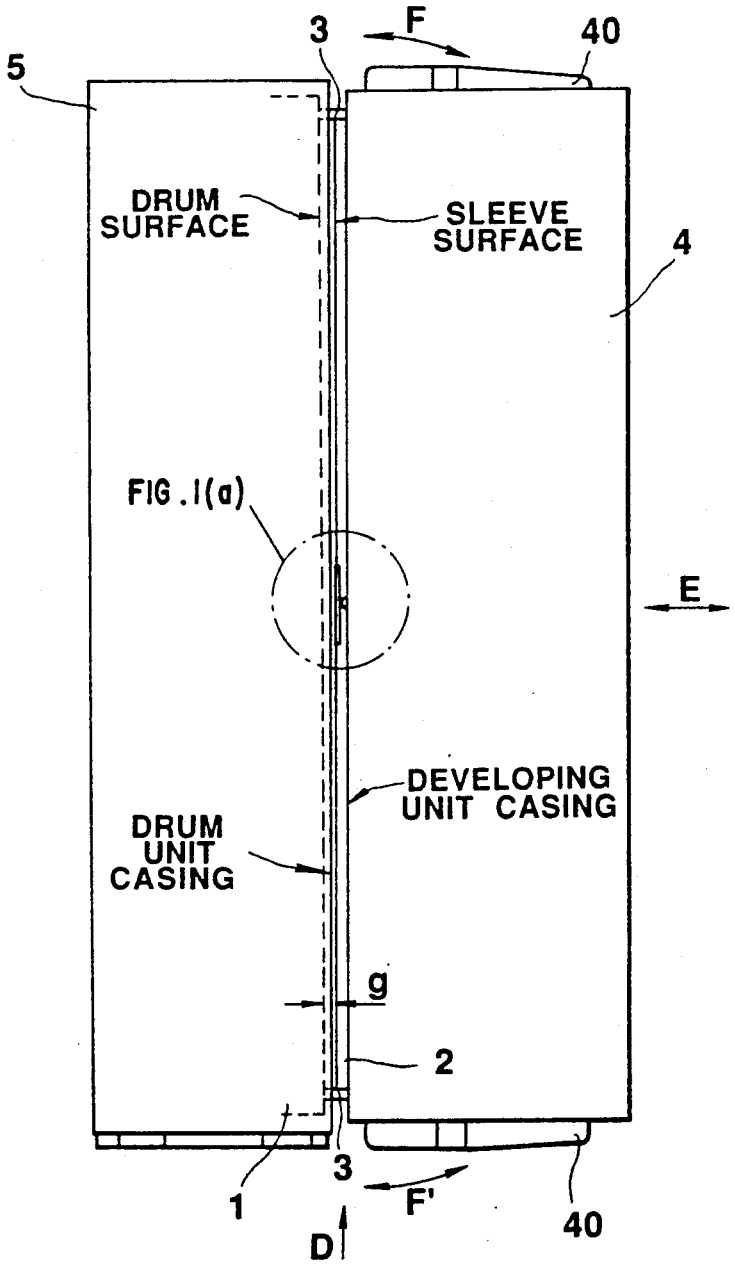
Figure 1C:
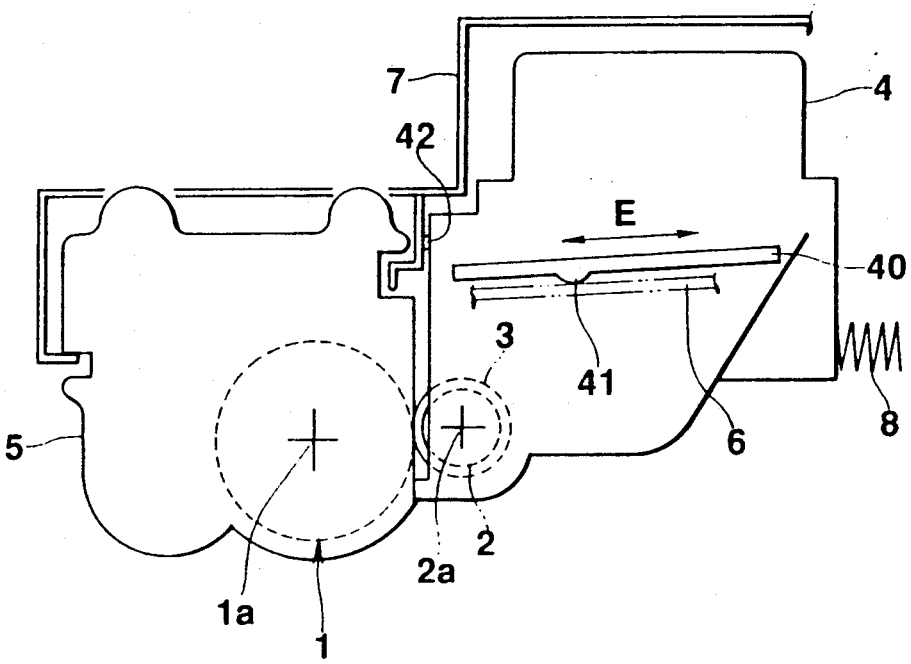

The present example is the same as the first example of FIGS. 1(a)-1(c) in that the developing unit 4 is engaged with the drum unit 5 at three points of the projection member 42a and collars 3a. For example, when the central axis 1a of the photosensitive drum 1 is biased, this causes the sleeve 2 to be pivoted to follow the biasing operation, thus resulting in generation of a uniform developing gap between the drum 1 and sleeve 2 at all times.

At a position of the developing unit 4 opposed to the projection member 42a of the drum unit 5, a recessed portion 43a for fitting engagement with the projection member 42a is provided in the developing unit 4.

The recessed member 43a acts, when it fittedly receives the projection member 42a, to further facilitate the positioning of the sleeve 2 relative to the predetermined scanning position on the photosensitive drum 1.

Figure 4A:
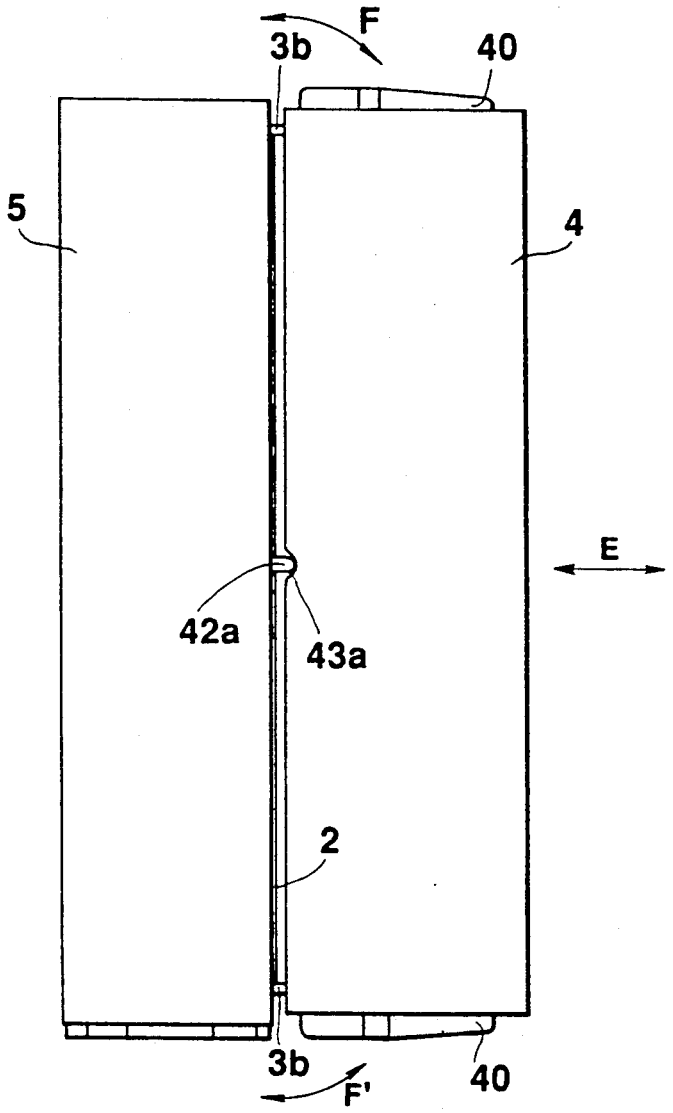
Figure 4:
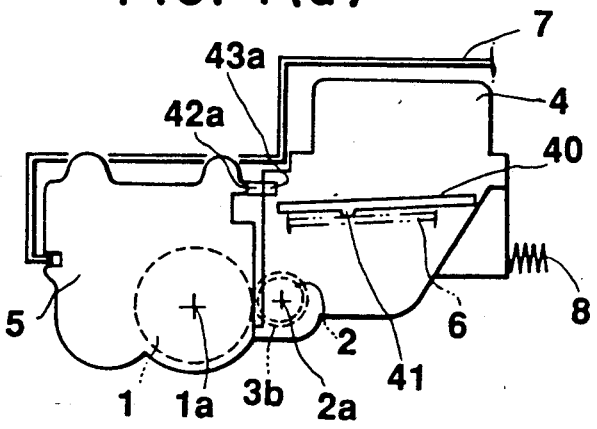
Figure 5A:
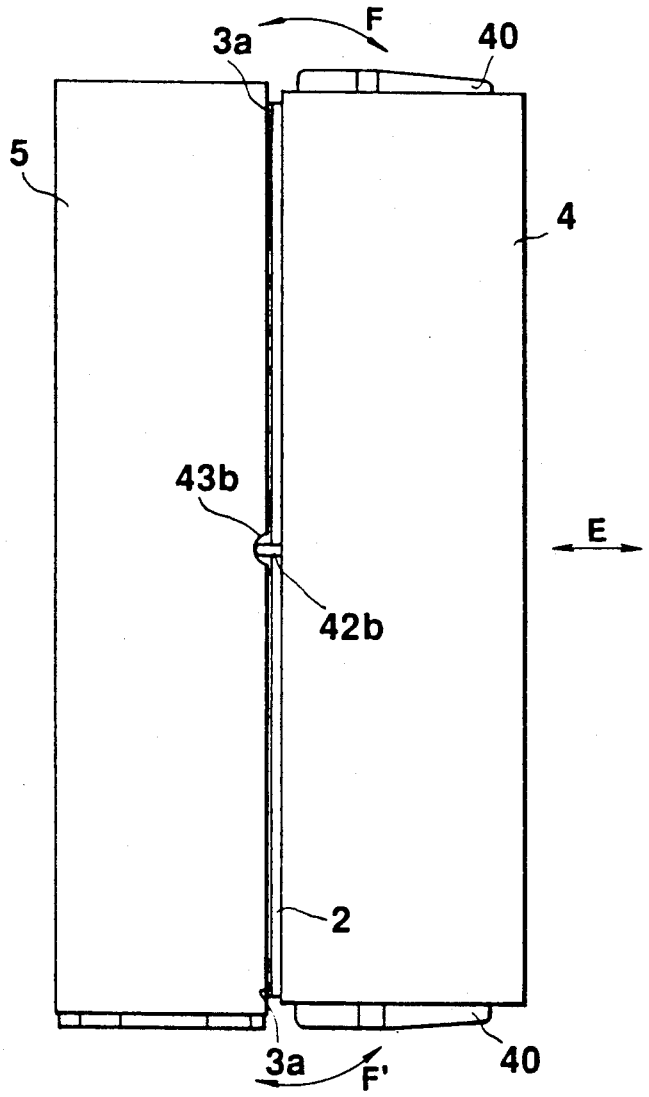
Figure 5B:
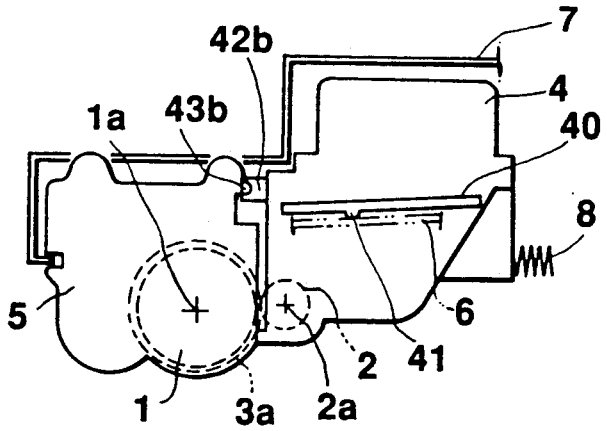
Figure 6:
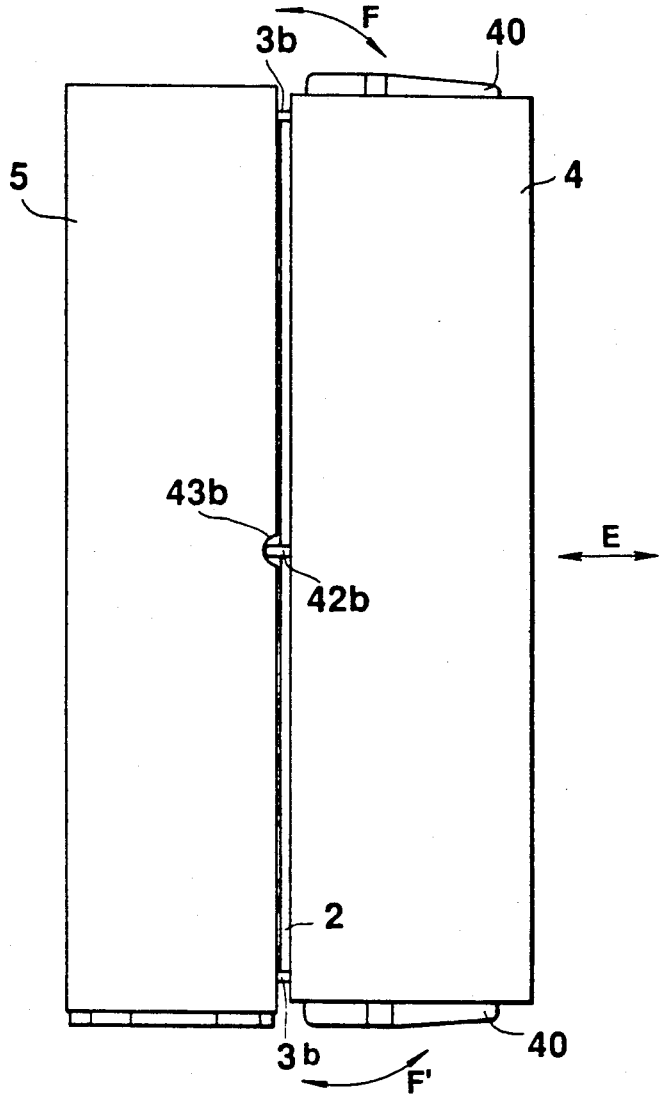
Figure 6:
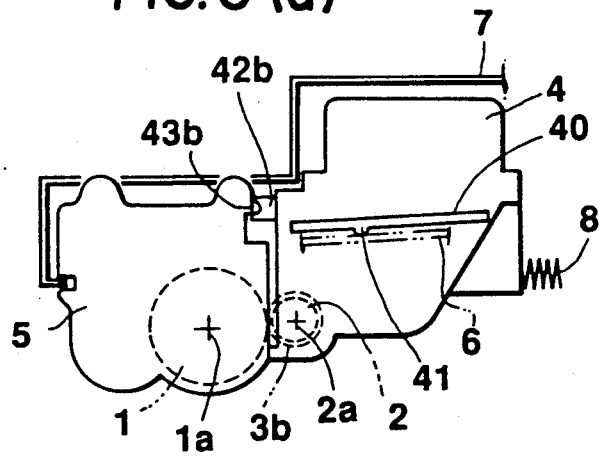

Next, in an example of FIGS. 4(a)-4(c), collars 3b are provided on the side of the sleeve 2 while the projection member 42a is provided on the side of the drum unit 5.

Even with the present structure, the developing unit 4 is provided with the recessed portion 43a which is opposed to the projection member 42a of the drum unit 5 to be engaged therewith.

The present structure is substantially the same as the foregoing examples in that the both units are engaged with each other at three points of the collars 3b and projection member 42a and the action of these members including the recessed portion 43a is also substantially the same as in the foregoing example, though the collars 3a are replaced by the collars 3b.

FIGS. 5(a) and 5(b) and FIGS. 6(a) and 6(b) show examples in which, as opposed to the foregoing examples, a projection member 42b is provided on the side of the developing unit 4 while a recessed portion 43b is formed in the drum unit 5 at a position opposed to the projection member 42b.

These examples of FIGS. 5(a) and 5(b) and FIGS. 6(a) and 6(b) are different from each other only in that the collars 3a are provided on the side of the photosensitive drum 1 in the former example as in the example of FIGS. 3(a) and 3(b), whereas the collars 3b are provided on the side of the sleeve 2 in the latter example as in the example of FIGS. 4(a) and 4(b).

All the examples of FIGS. 3(a) to 6(b) have the same structure that the developing units 4 is engaged with the drum unit 5 at the three points corresponding to the collars 3 provided at the both ends of the drum 1 or sleeve 2 and also to the longitudinal central projection member 42 thereof, and also have such a common advantage that the developing unit 4 follows the biasing action of the drum 1 to keep the axial parallel relation between the drum 1 and sleeve 2, thereby securing the uniform developing gap therebetween at all times.

The variations of these examples may satisfy design requirements.

Figure 7:
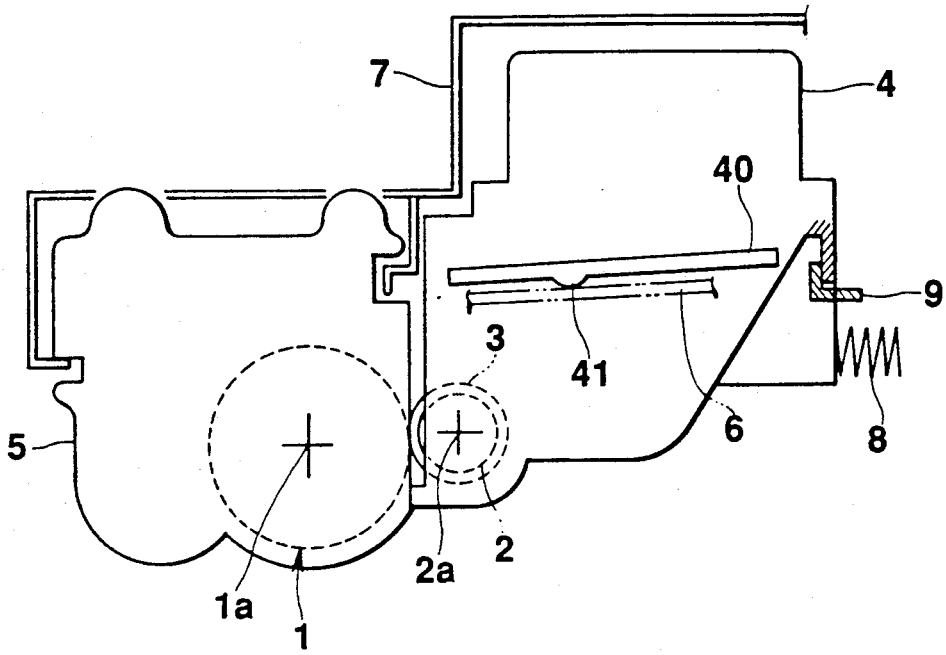
FIG. 7 is a side view of yet another embodiment of the electrophotographic recording apparatus of the present invention.

Such an arrangement as shown in FIG. 7 is further considered as another embodiment, in which case the developing unit 4 is supported by means of a hook mechanism 9 provided on the rear side of the unit 4 opposed to the drum unit 5 at its longitudinal central position.

The present structure of FIG. 7 is different from that of FIG. 1(b) in that the developing unit 4 is supported by the hook mechanism 9 and there is not provided the projection member 42 thereto.

However, in the present arrangement, the hook mechanism 9 has the same function as the projection member 42.

More in detail, though the hook mechanism 9 is provided on the rear side of the developing unit 4, the unit 4 is supported at a single center point between the collars 3 provided at the both ends of the sleeve 2, in which case the sleeve 2 is pivotably supported with respect to the photosensitive drum 1 while the both collars 3 are brought into tight contact with the photosensitive drum 1. In this respect, the present arrangement has substantially the same operation as those of FIGS. 3(a) to 6(b).

As a result, even when the photosensitive drum 1 is biased in its central axis, the sleeve 2 is pivoted while keeping the tight relation of the collars 3 with respect to the drum 1, whereby the drum 1 can be maintained always axially parallel with respect to the sleeve 2.

Accordingly, exactly in the same manner as in the case of using the projection member 42, a uniform developing gap corresponding to the diameter difference between the collars 3 and sleeve 2 can be obtained always between the photosensitive drum 1 and sleeve 2 and thus this contributs to a remarkable improvement in the quality of the recorded picture image.

In addition, in the arrangement of FIG. 7, the collars 3 may be attached to the photosensitive drum 1 or sleeve 2 based on the respective mounting methods of FIGS. 3 to 6, as a matter of course.

What is claimed is:

1. A structure for mounting recording units in an electrophotographic recording apparatus including a drum unit, a photosensitive drum provided in said drum unit, a developing unit, and a sleeve provided in said developing unit, wherein said developing unit is mounted to said drum unit so that a uniform developing gap is formed between said photosensitive drum and said sleeve along their longitudinal directions, said structure comprising:

collar means, provided at both ends of one of said photosensitive drum and said sleeve in its rotational axis direction to be tightly contacted with an opposing one of said photosensitive drum and said sleeve, for providing said uniform developing gap:

a projection member provided at a longitudinal central point of one of said drum unit and said developing unit;

pushing means for pushing said developing unit toward said drum unit to cause said projection member to abut against one of the opposing unit and a body casing and to cause said collar means to come into tight contact with said opposing one of said photosensitive drum and said sleeve; and guiding means for slidably guiding said developing unit to cause said sleeve to be positioned under influence of said pushing means at a predetermined scanning position on said photosensitive drum.

2. A structure for mounting recording units in an electrophotographic recording apparatus as set forth in claim 1, wherein said collar means are circular rollers each loosely fitted on one of said ends and having a diameter larger by said uniform developing gap than said one of said photosensitive drum and said sleeve, and said projection member projects from one of said drum unit and said developing unit toward the opposing unit.

3. A structure for mounting recording units in an electrophotographic recording apparatus as set forth in claims 1 or 2, wherein said unit opposed to said unit having said projection member provided thereto is provided with a recessed portion which opposes said projection member and which has a shape suitable for fitted reception of the projection member.

4. A structure for mounting recording units in an electrophotographic recording apparatus including a drum unit, a photosensitive drum provided in said drum unit, a developing unit, and a sleeve provided in said developing unit, wherein said developing unit is mounted to said drum unit so that a uniform developing gap is formed between said photosensitive drum and said sleeve along their longitudinal directions, said structure comprising:

collar means, provided at both ends of one of said photosensitive drum and said sleeve in its rotational axis direction to be tightly contacted with an opposing one of said photosensitive drum and said sleeve, for providing said uniform developing gap;

a hook means for engagedly supporting said developing unit at its longitudinal central point thereon;

pushing means for pushing said developing unit toward said drum unit to cause said developing unit to be engagedly supported by said hook mechanism and also to cause said collar means to come into contact with said opposing one of said photosensitive drum and said sleeve; and guiding means for slidably guiding said developing unit to cause said sleeve to be positioned under influence of said pushing means at a predetermined scanning position on said photosensitive drum.

5. A structure for mounting recording units in an electrophotographic recording apparatus as set forth in claim 4, wherein said hook means is provided on a rear side of said developing unit facing said drum unit.

6. A method of mounting recording units in an electrophotographic recording apparatus including a drum unit, a photosensitive drum provided in said drum unit, a developing unit, and a sleeve provided in said developing unit, wherein said developing unit is mounted to said drum unit so that a uniform developing gap is formed between said photosensitive drum and said sleeve along their rotational axis directions, comprising the steps of:

bringing two collar members provided at both ends of one of said photosensitive drum and said sleeve in its rotational axis direction into tight contact with an opposing one of said photosensitive drum and said sleeve to keep a uniform spacing distance corresponding to said uniform developing gap; and pivotably supporting said developing unit about a pivotable supporting point opposed to said drum unit at its longitudinal central point thereof to allow said sleeve to movably follow a biasing action of said rotational axis of said photosensitive drum with a parallel relation kept between said rotational axes of said sleeve and said photosensitive drum and with said uniform spacing distance between said sleeve and photosensitive drum maintained.

7. A method of mounting recording units in an electrophotographic recording apparatus as set forth in claim 6, wherein a projection member extruding from one of said drum unit and said developing unit toward the opposing unit is used as said pivotable supporting point of said developing unit.

8. A method of mounting recording units in an electrophotographic recording apparatus as set forth in claim 10, wherein a hook mechanism provided on a rear side of said developing unit facing said drum unit is used as said pivotable supporting point of said developing unit.

9. A structure for mounting recording units in an electrophotographic recording apparatus as set forth in claim 1, wherein said drum unit and said developing unit are supported at three points constituted by said projection means and said collar means so as to cause said sleeve to follow any biasing action of the photosensitive drum by rolling said developing unit about said projection means to thereby always keep said uniform developing gap between said drum and said sleeve.

10. An electrophotographic recording apparatus, comprising:

a drum unit having a first end and a second end;

a photosensitive drum, included in said drum unit, having a peripheral surface, a rotational axis, a first end, and a second end;

a developing unit having a first end and a second end;

a sleeve, included in said developing unit, having a peripheral surface, a rotational axis, a first end, and a second end;

means for urging the developing unit and the drum unit together;

collar means, for contacting the peripheral surface of the photosensitive drum at the first end and the second end of the photosensitive drum, for contacting the peripheral surface of the sleeve at the first end and the second end of the sleeve, and for forming a uniform developing gap between the sleeve and the photosensitive drum in order to keep the rotational axis of the sleeve substantially parallel to the rotational axis of the photosensitive drum; and means for contacting the developing unit between the first end and the second end of the developing unit, and for pivotally positioning the developing unit, in order to keep the rotational axis of the sleeve substantially parallel to the rotational axis of the photosensitive drum at times when the rotational axis of the photosensitive drum is biased;

wherein the sleeve of the developing unit is positioned at a predetermined scanning position on the peripheral surface of the photosensitive drum.

11. An electrophotographic recording apparatus in accordance with claim 10, in which the means for contacting the developing unit includes a projection means for contacting the drum unit between the first end and the second end of the drum unit, for contacting the developing unit between the first and second end of the developing unit, and for pivotally spacing the drum unit apart from the developing unit.

12. An electrophotographic recording apparatus in accordance with claim 10, in which the means for contacting the developing unit includes a hook means for contacting the developing unit between the first end and the second end of the developing unit, for pivotally supporting the developing unit, and for spacing the developing unit apart from the drum unit.

13. An electrophotographic recording apparatus in accordance with claims 10, 11, or 12 in which:

the photosensitive drum is cylindrical; and the sleeve is cylindrical.

14. An electrophotographic recording apparatus in accordance with claim 13, in which the collar means comprises a pair of circular rollers that loosely fit on the first end and the second end of the photosensitive drum, and that rotate independently of the photosensitive drum.

15. An electrophotographic recording apparatus in accordance with claim 13, in which the collar means comprises a pair of circular rollers that loosely fit on the first end and the second end of the sleeve, and that rotate independently of the sleeve.

16. An electrophotographic recording apparatus in accordance with claim 11, in which the projection means comprises a projection on the drum unit that projects toward the developing unit.

17. An electrophotographic recording apparatus in accordance with claim 16, in which the developing unit includes a recessed portion for contacting the projection on the drum unit, and wherein the projection on the drum unit pivots within the recessed portion on the developing unit.

18. An electrophotographic recording apparatus in accordance with claim 11, in which the projection means comprises a projection on the developing unit that projects toward the drum unit.

19. An electrophotographic recording apparatus in accordance with claim 18, in which the drum unit includes a recessed portion for contacting the projection on the developing unit, and wherein the projection on the developing unit pivots within the recessed portion on the drum unit.

20. An electrophotographic recording apparatus in accordance with claim 10, 11, or 12 in which the means for urging the developing unit and the drum unit together includes means for slidably guiding the developing unit toward the drum unit.

21. A method for mounting recording units in an electrophotographic recording apparatus, wherein the electrophotographic recording apparatus includes a drum unit having a first end and a second end; a photosensitive drum, included in said drum unit, having a peripheral surface, a rotational axis, a first end, and a second end; a developing unit having a first end and a second end; a sleeve, included in said developing unit, having a peripheral surface, a rotational axis, a first end, and a second end; and a collar; and wherein the method comprises the following steps:

urging the developing unit and the drum unit together;

contacting the peripheral surface of the photosensitive drum with the collar at the first end and the second end of the photosensitive drum;

contacting the peripheral surface of the sleeve with the collar at the first end and the second end of the sleeve;

spacing the peripheral surface of the sleeve a substantially uniform distance apart from the peripheral surface of the photosensitive drum with the collar, in order to keep the rotational axis of the sleeve substantially parallel to the rotational axis of the photosensitive drum, and in order to form a developing gap between the sleeve and the photosensitive drum; and contacting the developing unit between the first end and the second end of the developing unit, and pivotally positioning the developing unit, in order to keep the rotational axis of the sleeve substantially parallel to the rotational axis of the photosensitive drum at times when the rotational axis of the photosensitive drum is biased;

wherein the sleeve of the developing unit is positioned at a predetermined scanning position on the peripheral surface of the photosensitive drum.

* * * * *